United States Patent [19]

Ingemann

[11] Patent Number: 5,007,231

[45] Date of Patent: Apr. 16, 1991

[54] CONTAINER

[75] Inventor: Ole Ingemann, Ryslinge, Denmark

[73] Assignee: PLM AB, Malmo, Sweden

[21] Appl. No.: 289,385

[22] Filed: Dec. 23, 1988

Related U.S. Application Data

[62] Division of Ser. No. 46,048, Apr. 16, 1987, Pat. No. 4,795,055.

[30] Foreign Application Priority Data

Aug. 18, 1986 [SE] Sweden ..... 8503830

[51] Int. Cl.[5] ..... B65B 7/28; B65B 61/18

[52] U.S. Cl. ..... 53/412; 53/449; 53/478; 220/270; 220/257; 220/258; 220/359

[58] Field of Search ..... 220/270, 272, 273, 276, 220/257, 258; 215/251; 53/412, 449, 471, 478, 489, 492

[56] References Cited

U.S. PATENT DOCUMENTS

| | | | |
|---|---|---|---|
| 2,880,859 | 4/1959 | Tupper | 215/251 X |
| 3,069,273 | 12/1962 | Wayne | 99/171 |
| 3,498,018 | 3/1970 | Seiferth et al. | 53/22 |
| 3,693,827 | 9/1972 | Baumeyer et al. | 220/270 |
| 3,838,785 | 10/1974 | Lancesseur | 215/251 |
| 3,952,912 | 4/1976 | Perry | 220/268 X |
| 3,981,412 | 9/1976 | Asmus | 220/276 X |
| 4,212,409 | 7/1980 | Jeppsson | 220/270 X |
| 4,267,937 | 5/1981 | Piltz et al. | 220/270 X |
| 4,360,121 | 11/1982 | Helms | 220/270 |
| 4,387,551 | 6/1983 | Cowan | 53/478 |
| 4,394,917 | 7/1983 | Looser | 215/232 |
| 4,448,324 | 5/1984 | Jeppsson et al. | 220/270 X |
| 4,501,375 | 2/1985 | Katsura et al. | 220/270 |
| 4,529,100 | 7/1985 | Ingemann | 220/270 X |
| 4,738,374 | 4/1988 | Ingemann | 220/258 |
| 4,795,055 | 1/1989 | Ingemann | 220/270 |
| 4,896,479 | 1/1990 | Gannon | 53/432 |

FOREIGN PATENT DOCUMENTS

| | | | |
|---|---|---|---|
| 1761411 | 1/1970 | Fed. Rep. of Germany | 220/257 |
| 1123250 | 9/1956 | France | 215/251 |
| 1545647 | 7/1967 | France | 220/270 |

*Primary Examiner*—George E. Lowrance
*Assistant Examiner*—Stephen K. Cronin
*Attorney, Agent, or Firm*—Ladas & Parry

[57] ABSTRACT

An easily-opened container includes a container body with an opening portion and a lid cooperating with the opening portion. The lid has a central lid portion and a peripheral portion located outside this lid portion and sealingly and permanently fixed to the opening portion for closing the container. The central lid portion and the peripheral portion are separated from one another by a weakened portion which extends in the circumferential direction of the opening portion and at least partially around the opening portion. In a restricted region, the opening portion is provided with a recess located beneath the weakened portion. A stripping unit with fulcrum-effect is pivotally supported in a support region. The stripping device has a pull member and a pressure member, the latter abutting against the outer surface of the lid inside the weakened portion and above the recess in order, on lifting the pull member, to realize, by pressure against the above-mentioned region, material rupture in the weakened portion and thereby initiate opening of the container.

10 Claims, 5 Drawing Sheets

CONTAINER

This is a Divisional of application Ser. No. 046,048 filed 4/16/87, now U.S. Pat. No. 4,795,055, issued 1-3-89.

The present invention relates to an easily-opened container application Ser. No. 046,048 filed 4/16/87, now U.S. Pat. No. 4,795,055, issued 1-3-89. comprising a container body with an opening portion and a sealed bottom portion, a lid with a central lid portion and a peripheral portion disposed outside this lid portion, and one or more connecting devices which sealingly fix the lid to the container body for sealing of the container and opening means. The opening means include a weakened portion located in the lid and formed by a material region of reduced strength, the weakened portion being located inside the connecting devices and extending in the circumferential direction of the opening portion and, in such instance, at least partially around this opening portion. In the weakened portion, the central section is separable from adjacent regions of the peripheral portion. The opening means further include means for facilitating the above-mentioned separation.

In many contexts, there is a need for easily-opened containers. In many physical applications, there are also requirements that the opened container may be readily resealable. As a rule, the requirement of ready reclosure obtains in situations where the container is gradually emptied of its contents in individual stages. Such batch-wise emptying of a container is often employed when the container is used for the storage of foods.

A further requirement placed on a container for the above-outlined purposes is that it must, as far as is possible, be of a construction which safeguards against unintentional opening. In particular in physical applications in which the lid of the container is provided with a weakened portion, for example, a circumferential weakened zone, there may be a risk of such unintentional opening when the lid portion inside the weakened zone is exposed to compressive forces.

Hence, the present invention relates to a container in which the above-outlined requirements have been satisfied. According to the invention, the opening portion of the container body is, in a defined region, provided with a depression or recess located beneath the weakened portion. The opening means include a fulcrum-action unit journaled in a support point (support region), this fulcrum-action unit including a pull member and a pressure member, these members being located on either side of the support point (the support region). The pressure member abuts against the outer surface of the lid in the region of, or adjacent to, the weakened portion where this is located above the depression or recess. On raising of the pull member, a fulcrum-effect is created about the support point (the support region), the pressure member being urged towards the region of, or adjacent to, the weakened portion, and realizing material rupture therein. When the weakened portion has been pierced or penetrated, relatively slight forces are necessary to continue opening of the container by stripping at the weakened portion.

In one preferred embodiment of the present invention, the fulcrum-effect unit is fixed to the central lid portion. As a rule, the fulcrum-effect is fixed to the central lid portion by means of a rivet-like arrangement, preferably of a plastic material. In fields of application in which the lid consists of plastic material, the rivet-like arrangement also consists, as a rule, of plastic material. When the rivet-like arrangement consists of plastic material, it generally constitutes an integral part of the lid.

In one embodiment of the present invention, the pressure member terminates in the region most distal from the support point by an edge which is located substantially above the weakened portion. The pull member is often designed with a pull-ring.

In yet a further preferred embodiment of the present invention, the opening portion is provided with a flared flange to which the peripheral portion of the lid is sealingly fixed. In certain applications, the peripheral portion of the lid consists of a flared flange.

Generally, the central peripheral portion of the lid is, here located on a lower level than the flared flange of the lid, while in other applications, the central portion of the lid is located flush with or higher than its flared flange.

In still a further preferred embodiment of the present invention, each connecting member consists of a weld which, in containers of plastic material, is preferably formed by ultrasonic welding.

In certain applications, the weakened portion consists of a material region whose strength has been reduced by crystallization.

The nature of the present invention and its aspects will be more readily understood from the following brief description of the figures of the accompanying drawings, and discussion relating thereto.

Figure 10A:
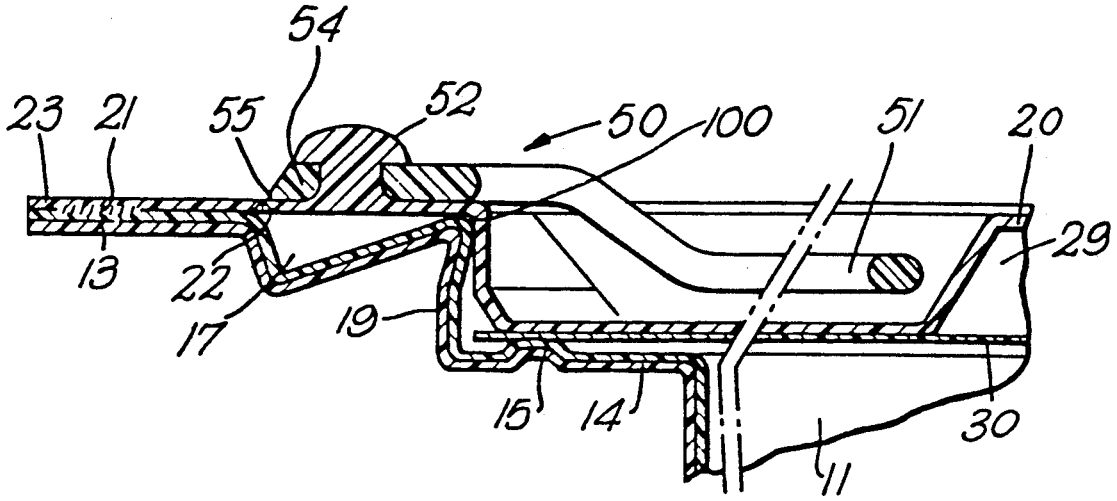
Figure 10B:
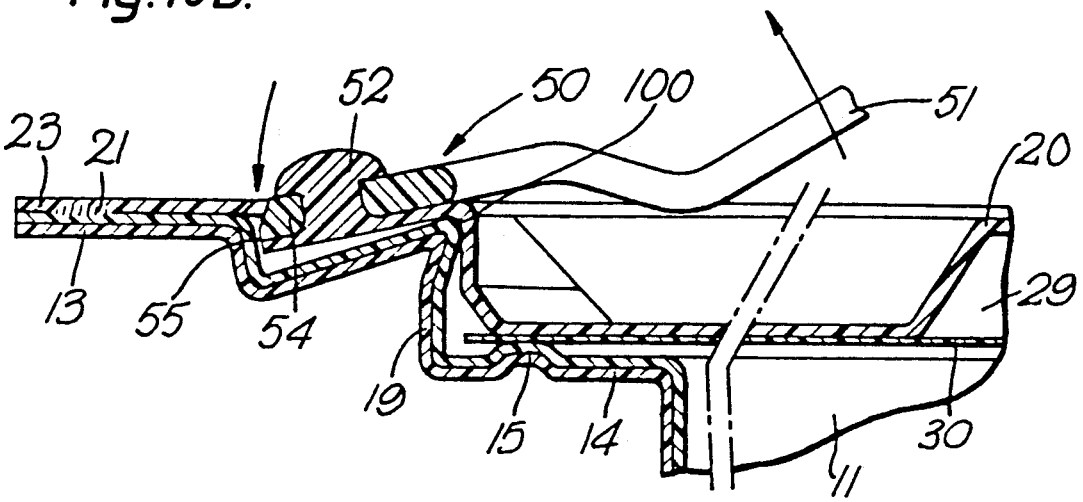
Figure 11:
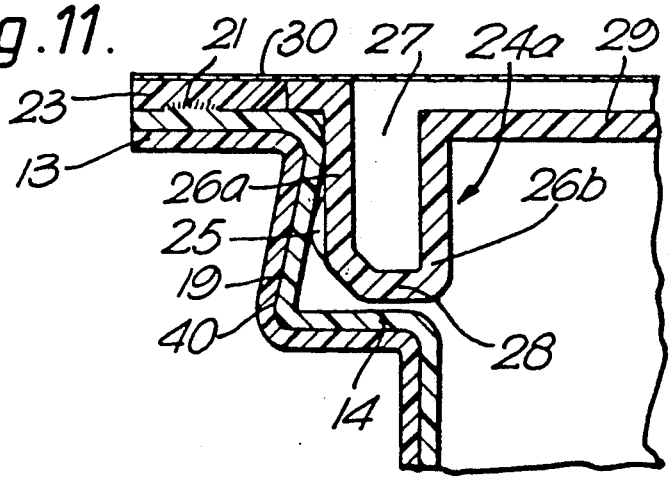

FIGS. 10*a* and 10*b* are partial sections through one embodiment of an opening portion of a factory-sealed container in the region where opening of the factory-sealed container is commenced; and FIG. 11 is a partial section through yet a further embodiment of a container according to the present invention.

Referring to the drawing figures, different embodiments of a container 10 are shown, comprising a container body 11 and a bottom portion 18. The container body has an opening portion 12 which is bounded by an anchorage portion 13 for a lid 20. In the illustrated embodiments, the container body is, seen from the anchorage portion 13 in a direction towards the bottom portion 18, provided with shoulder 14 which extends in the circumferential direction of the container and, in one preferred embodiment, throughout the entire circumference of the container. As seen in the application shown in FIGS. 1–7, the shoulder constitutes a substrate for a supplementary, inner lid or membrane 30. In such instance, the shoulder is, as a rule, provided with at least one circumferentially oriented and upwardly directed bead 15 (cf. FIG. 9), which has a bulge 16 in a region where stripping of the inner lid is commenced. In other applications, the shoulder is primarily provided to offer support to the opening portion, while in other applications, its primary duty is to constitute an arrest means which, on resealing of the container, restricts the movement of the lid towards the bottom portion. The present invention also contemplates embodiments in which the shoulder or its counterpart is wholly dispensed with. Nevertheless, it will be obvious to those skilled in the art that one of the above-disclosed functions of the shoulder does not preclude the others.

In certain embodiments, the container body is provided, between the shoulder 14 and the anchorage portion 13, with a wall portion 19 which is preferably oriented substantially in the axial direction of the container body. The figure also show a recess or depression 17, disposed in the container body. In a cornered container, The recess is located, in one preferred embodiment, immediately adjacent one of the corners of the container. As a result, effect on the storage space of the container will be reduced to a minimum, and, at the same time, opening of the container starts in a favourable region from the point of view of broaching and opening, in other words as regards the direction of the tractive forces required for the continued stripping and opening process, once the weakened portion has been broached. In certain embodiments, the container body is provided with a layer of barrier material 40 which, for example, may consist of aluminum foil, ethylvinyl alcohol, polyvinyl dichloride etc.

The dimensions of the inner lid 30 are adapted to the opening of the container body in order to be passed down and sealingly fixed in the opening, for example, at the shoulder 14. In one preferred embodiment of the present invention, such fixation is effected against the bead 15, for example by heat sealing. The inner lid is provided with a gripping member 32 at its bounding edge 33, the gripping member being shown in the drawing figures as a flap 34, but may, in other embodiments, also consist of a folded-over portion of the edge 33 which extends along a shorter or longer extend of the circumference of the inner lid 30. In certain embodiments, a layer of barrier material 41 is included in the inner lid, for example barrier material of the above-described types.

Figure 1:
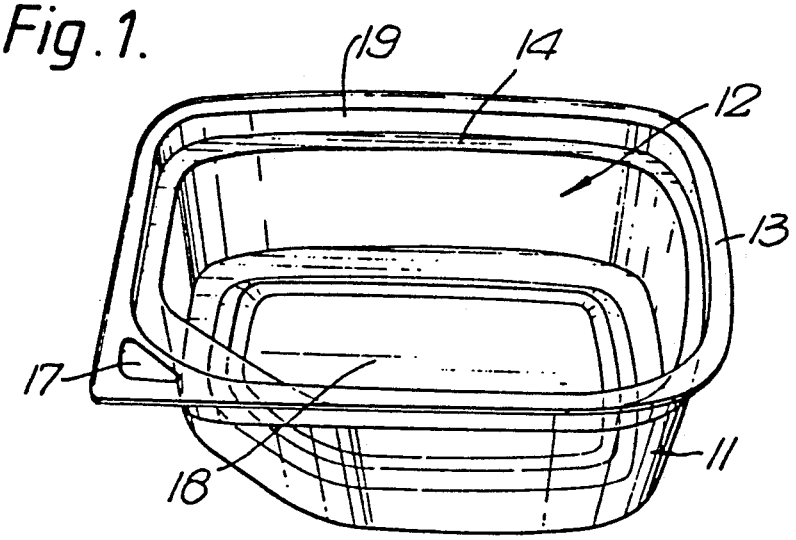
FIGS. 1–7 illustrate one embodiment of the present invention in which an outer lid of a container is provided for easy opening according to the invention.
Figure 2:
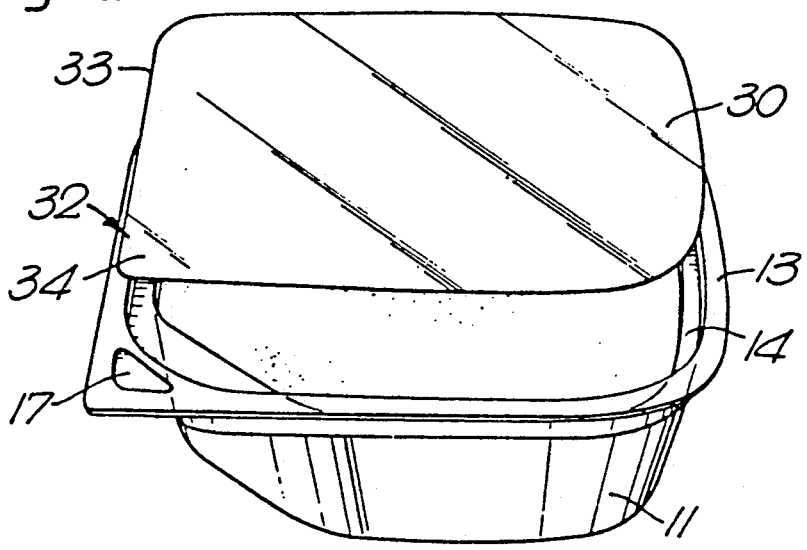
Figure 3:
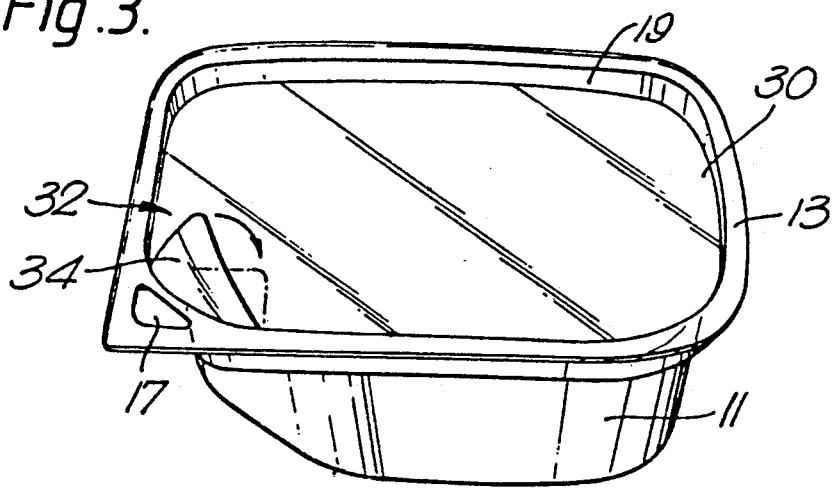
Figure 4:
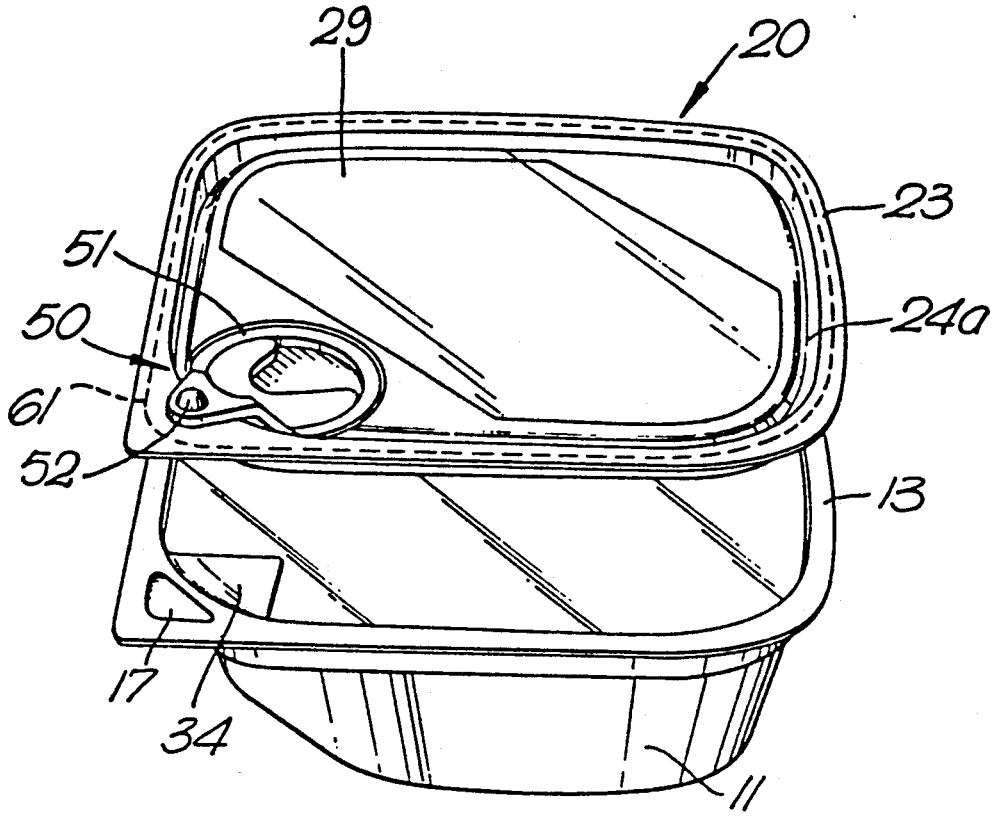
Figure 5:
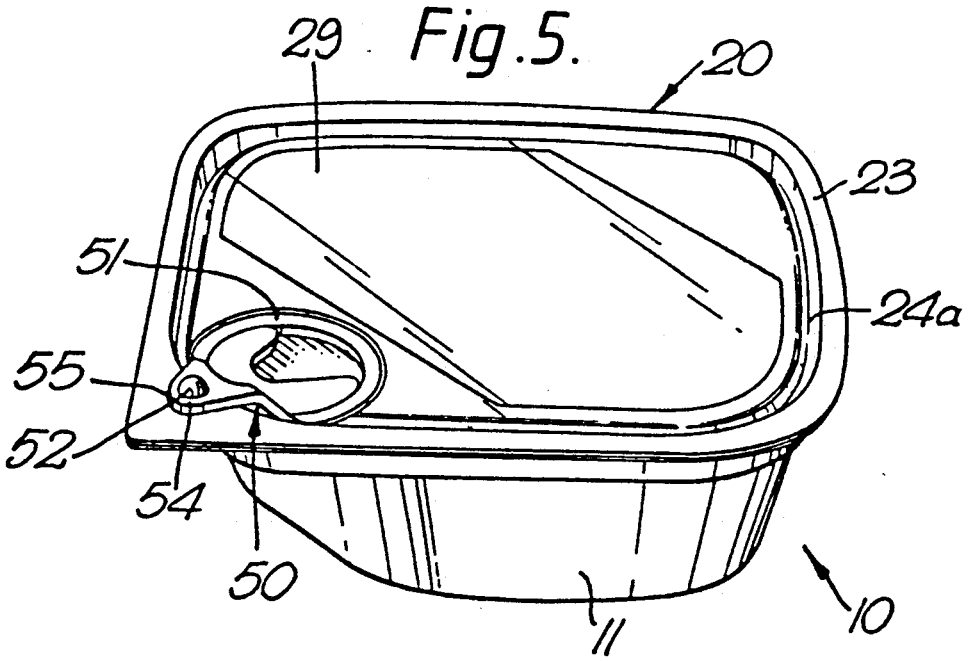
Figure 6:
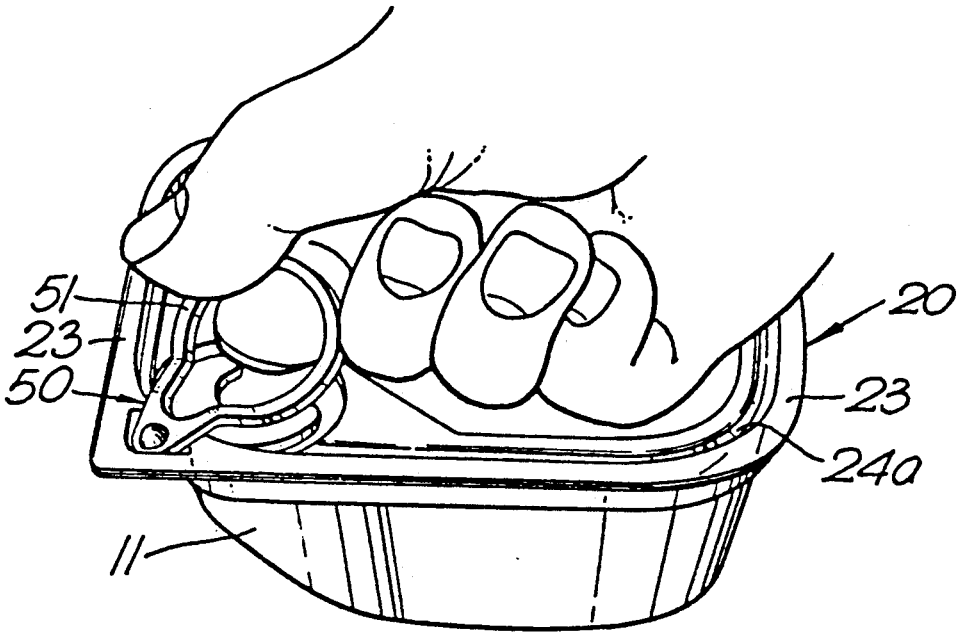
Figure 7:
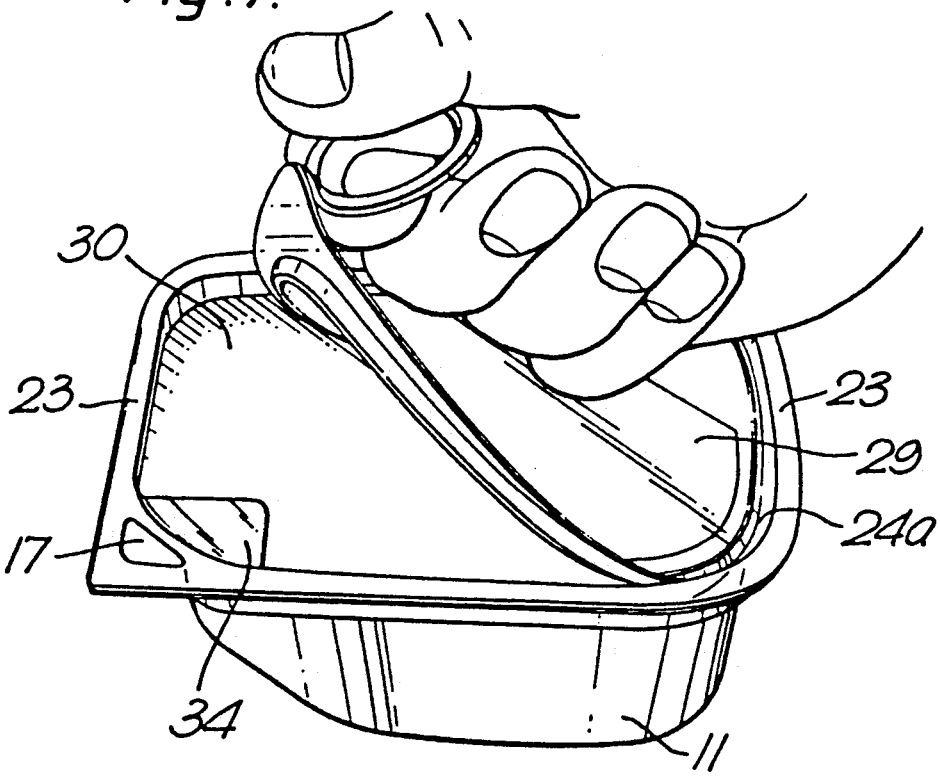
Figure 8:
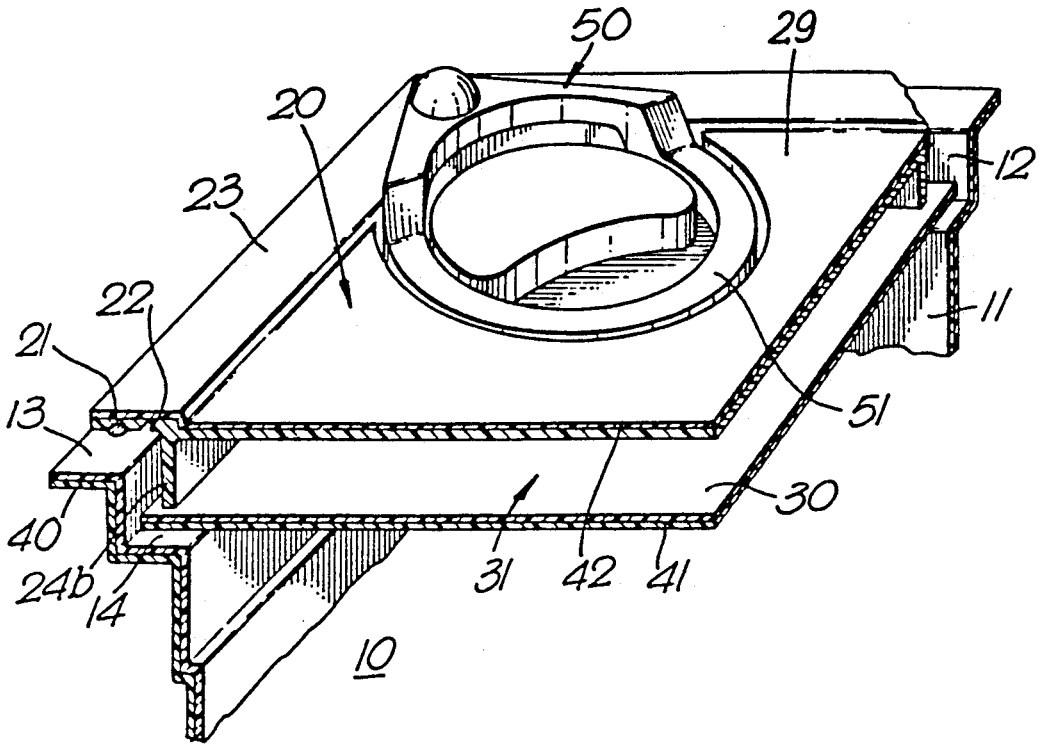
FIG. 8 shows a cut-away portion of one embodiment of a factory-sealed container.

The lid 20, hereinafter occasionally designated a first lid or outer lid 20 - with no restrictive implication to the scope of the present invention - is shown in the drawing figures in one embodiment in which it is provided with an anchorage portion 23 corresponding to the anchorage portion 13 of the container body and disposed in the circumferential direction of the lid corresponding to that disclosed for the anchorage portion of the container body. By the intermediary of a weakened portion (the stripping line 22, cf. FIG. 6), the anchorage portion merges, in a direction towards the centre of the lid, into a central lid portion 29 which, an opening of the container, constitutes that portion of the lid which is removed from the container. The central lid portion is, as a rule, provide, in the region adjacent the stripping line 22, with a depending portion 24*a, b* (cf. FIGS. 4 and 8), the depth of which in a direction towards the bottom being adapted to the distance to the above-mentioned shoulder 14, such that the depending portion extends into proximity with the shoulder 14. In certain embodiments of the present invention, a layer 42 of barrier material is also included in the lid, for example of the above-indicated types.

The drawing figure also show how the anchorage portion 13 of the container body is sealingly connected to the anchorage portion 23 of the first lid by a permanent connection 21 which, in one preferred embodiment of the present invention, consists of a welded joint for example realized by ultrasonic welding. In order to locate the welded joint and facilitate its formation, at least one of the anchorage portions 13, 23 is provided with at least one welding cam 61 facing the outer anchorage portion. The position of such a welding cam is indicated by reference numeral 61 in FIG. 4.

The drawing figure also show that the first lid 20 is provided with a stripping device 50 fitted with a pull-ring 51 located on one side of the fixation member 52 of the stripping member to the first lid 20, while the stripping device is provided, on the other side of the fixation member, with a projecting portion 54, which, in one preferred embodiment of the present invention, terminates in its end region by an edge 55 abutting against the outer surface of the lid. The stripping device consists of a relatively rigid material, preferably a plastic material. In or beside the fixation region, the openig portion is provided with a mechanically stable edge 100 which forms a transition between the substantially vertical wall portion 19 and the recess 17. The stripping device forms a fulcrum about the above-mentioned edge. Since the distance between the stable edge 100 and the gripping portion of the pull-ring 51 is greater than the distance between the stable edge and the edge 50 of the projecting portion, a fulcrum-effect will be created whtn the pull-ring is raised, which facilitates rupture along the weakened stripping line 22.

Concerning the weakened stripping line 22, this is illustrated and described as having been formed by a groove-like recess, but it is obvious to a person skilled in the art that in certain embodiments, the weakened portion is formed in that the plastic material has been treated to reduce the strength of the material, for example has been heat-treated to alter the crystallinity of the material. Similarly, in the body of this specification, the weakened portion is shown in one embodiment of the present invention, in which it forms a closed loop, but it is obvious to the skilled reader that, in certain physical applications, the weakened portion may be disposed only at a part of the circumference of the container opening so that, on opening of the container, the central lid portion 29 of the first lid 20 will remain secured to the container body.

When a container according to the present invention is to be put into use, it is filled with the desired goods, whereafter the second lid 30 (where applicable) is mounted in place and sealingly fixed against the container body 11. Thereafter, the first lid 20 is applied and is also sealingly fixed to the container body 11. When the container is opened, the central lid portion 29 of the lid 20 will be separated wholly or partly from the anchorage portion 23 which, in the illustrated embodiments, is effected by means of the stripping device 50. When the pull-ring 51 is raised, the stripping device ruptures the connection of the central lid portion 29 to the anchorage portion 23 in that the weakened portion 22 is penetrated and/or broached. When portion 22 has been severed, only relatively small forces are required for the continued removal of the lid (cf. FIGS. 6 and 7). Once the central lid portion 29 of the first lid has been removed, the second lid 30 (where applicable) is removed in that the lid, in the illustrated embodiments, is removed by means of the gripping device 32. The container is thereafter fully open and its contents may be used.

The central lid portion of the first lid 20 is suited for reclosure of the container in that the depending portion 24 projecting towards the bottom constitutes, in certain embodiments of the present invention, arrest means which, in cooperation with the shoulder 14, restrict the movement of the central lid portion in a downward direction in the container. This particularly applies when the weakened portion is disposed substantially in alignment with the inner surface of the wall portion 19 of the container body. In certain embodiments, the weakened portion 22 is placed such that, once the weakened portion has been ruptured, there remains a flared flange on the central lid portion of the lid, this flange, in cooperation with the anchorage portion 13 of the container body, restricting the possibilities of the lid portion for removing towards the bottom of the container. As a result of the above-mentioned positioning of the weakened portion, the material of the lid of the factory-sealed container is supported on both sides of the weakened portion by the anchorage portion 23 of the opening. This arrangement prevents the weakened portion from rupturing on loading by external pressure against the inner lid portion in the region of the weakened portion. The depending portion 24*a, b* of the lid portion is, as a rule, dimensioned so as to abut against the inner wall surface of the opening portion and thereby realize a sealing upon reclosure of the container.

Figure 9:
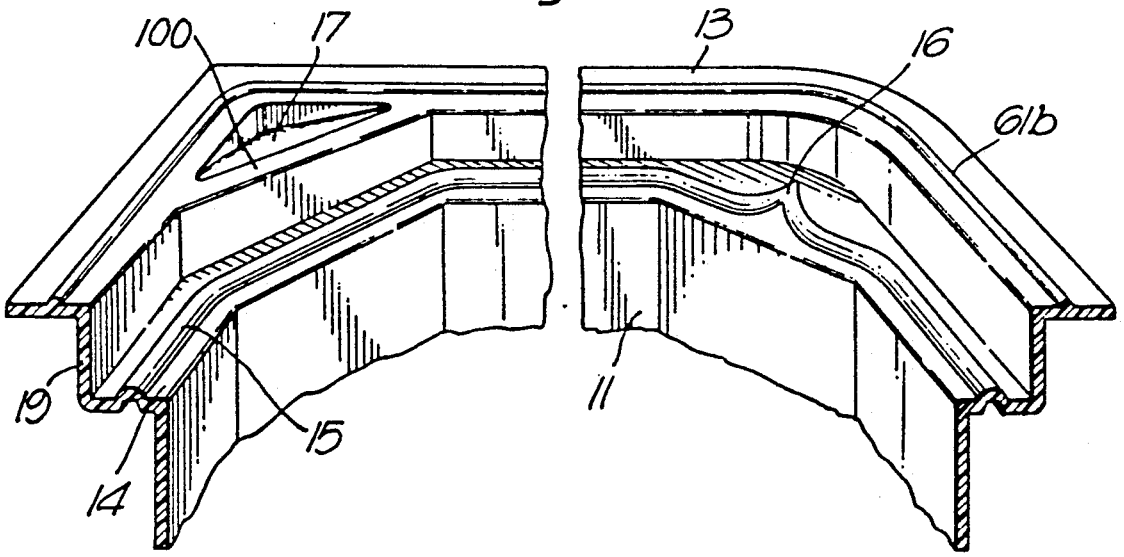
FIG. 9 shows, in perspective view, one embodiment of a sub-section of the opening portion of a container body in the region where opening of the container is commenced.

FIG. 9 illustrates one embodiment of the container in which the regions for initiation of opening of the first lid 20 and the second lid 30, respectively, are located in spaced apart relationship. This entails that the central lid portion 29 of the first lid must be raised a relatively great distance before the gripping member 32 of the second lid becomes accessible, with the result that any unauthorized tampering with the container will readily become noticeable.

FIG. 11 shows a partial section through the opening portion of one embodiment of the first lid 20. The partial section is located beside the stripping device. At its depending portion 24*a*, the lid is provided with one or more projecting portions 25 which cooperate with the substantially vertical wall portion 19 of the container body in the region between the shoulder 14 and the anchorage portion 13 in order, together with the wall portion, to form a snap engaging function. To this end, the wall portion 19 is slightly inclined downwardly and outwardly. In order to attain a certain spring action in the depending portion 24*a* of the lid, this portion is, in the embodiment illustrated in FIG. 11, composed of two substantially vertical wall portions 26*a, b* which are interconnected by a substantially horizontal wall portion 28 and, together with the vertical wall portions, forms a channel-like groove 27. This described construction also allows the lid to be manufactured by thermoforming. In the drawing figures, the containers have been illustrated with polygonal cross-section. However, it is obvious to a person skilled in the art that the present invention is applicable also to containers of any optional cross-sectional configuration, for example circular, oval, or combinations which include parts of polygonal and curved lines.

Even though the embodiments of the present invention described above comprise, as a rule, an inner and an outer lid, it will be obvious to a person skilled in this art that the present invention also embraces containers provided with only a single lid with designs corresponding to that described above for the first (outer) lid.

The above detailed description has referred to a limited number of embodiments of the present invention, but those skilled in the art will readily perceive that the present invention contemplates a large number of embodiments which fall within the spirit and scope of the appended claims.

I claim:

1. A method for sealing an open top of a container having a closed bottom and containing goods to be sealed against the ambient atmosphere, said method comprising attaching a first lid to the open top of the container by a peelable connection so that the lid seals the contents in the container, attaching a second lid to the container by a permanent sealed connection in a region outside the first lid to form a closed, sealed space between the lids, and forming the second lid with a weakened portion surrounding said peelable connection between said first lid and the open top of the container to enable separation of said second lid at said weakened portion and provide access to said first lid to enable its removal to gain access to the contents in the container.

2. A method as claimed in claim 1 wherein the second lid is attached to the container above the first lid.

3. A method as claimed in claim 1 comprising sever; the weakened portion of the second lid by lifting a member secured to the second lid.

4. A method as claimed in claim 3 wherein the weakened portion of the second lid is severed in a local region upon lifting said member, the remainder of said weakened portion being separated by applying a pulling force to said second lid through said member.

5. A method as claimed in claim 3 wherein after the weakened portion is severed by lifting said member, the second lid is separated at said weakened portion by pulling on said member.

6. A method as claimed in claim 5 comprising sealingly inserting the separated part of said second lid into the open top of the container to reseal said container.

7. A method as claimed in claim 5 comprising amplifying by lever action , the force applied to said member to sever said weakened portion of the second lid.

8. A method as claimed in claim 7 wherein said lever action is developed by pivotably supporting said member on the open top of the container as a fulcrum and said amplification of the force applied to the member is obtained by making the distance between the fulcrum and an engaging point on said member greater than the distance between the fulcrum and a point on said membeer which is to sever said weakened portion when said member is lifted.

9. A method as claimed in claim 8 comprising forming said container with a recess into which said engaging point on said member and a ruptured portion of said second lid are received when said weakened portion is severed.

10. A method as claimed in claim 8 wherein said second lid is attached to the container above the first lid, and said member is formed with an engaging portion which is located at a level between said first lid and the connection of the second lid to the container.

* * * * *